US010577771B2

(12) United States Patent
Jullienne

(10) Patent No.: US 10,577,771 B2
(45) Date of Patent: Mar. 3, 2020

(54) GROUND REINFORCING DEVICE

(71) Applicant: SOLETANCHE FREYSSINET, Rueil-Malmaison (FR)

(72) Inventor: Dominique Jullienne, Rueil-Malmaison (FR)

( * ) Notice: Subject to any disclaimer, the term of this patent is extended or adjusted under 35 U.S.C. 154(b) by 0 days.

(21) Appl. No.: 15/974,719

(22) Filed: May 9, 2018

(65) Prior Publication Data

US 2018/0327994 A1 Nov. 15, 2018

(30) Foreign Application Priority Data

May 10, 2017 (CA) ..... 2966761

(51) Int. Cl.
*E02D 27/02* (2006.01)
*E02D 27/38* (2006.01)
*E02D 3/12* (2006.01)

(52) U.S. Cl.
CPC ..... *E02D 27/38* (2013.01); *E02D 3/12* (2013.01); *E02D 27/02* (2013.01); *E02D 2200/1685* (2013.01); *E02D 2250/00* (2013.01); *E02D 2250/003* (2013.01); *E02D 2300/002* (2013.01)

(58) Field of Classification Search
CPC .. E02D 3/08; E02D 3/12; E02D 27/38; E02D 27/02; E02D 2200/1685; E02D 2250/00; E02D 2250/003; E02D 2300/002
See application file for complete search history.

(56) References Cited

U.S. PATENT DOCUMENTS 4,242,013 A * 12/1980 Watts ..... E02D 17/04 175/62
4,804,293 A * 2/1989 Varkonyi ..... E02B 3/126 405/15
4,828,431 A * 5/1989 Chen ..... E02B 17/0021 405/195.1
4,965,097 A * 10/1990 Bach ..... E02D 17/20 405/16
5,482,408 A * 1/1996 Lunardi ..... E02D 29/02 405/284
5,800,090 A * 9/1998 Goughnour ..... E02D 3/10 405/258.1
5,934,837 A * 8/1999 Lee ..... E02D 5/20 405/231
6,318,031 B1 * 11/2001 Nakamura ..... E02D 27/34 52/167.1
6,395,372 B1 * 5/2002 Bach ..... E02D 17/202 428/137
7,033,118 B2 * 4/2006 Hilfiker ..... E02D 29/0208 405/262

(Continued)

OTHER PUBLICATIONS

Sondermann et al., Ground improvement to reduce the liquefaction potential around pile foundations; Oct. 2011 (Year: 2011).*

(Continued)

*Primary Examiner* — Benjamin F Fiorello
(74) *Attorney, Agent, or Firm* — William Salinger; Yasser Mourtada; Robert Facey

(57) ABSTRACT

A soil reinforcing device for reinforcing a ground supporting a load structure, wherein said soil reinforcing device comprises a first assembly comprising:
- a plurality of cells extending vertically and forming a cell mesh;
- a plurality of draining devices extending vertically and located in said cells.

14 Claims, 3 Drawing Sheets

(56) References Cited

U.S. PATENT DOCUMENTS

| | | | | |
|---|---|---|---|---|
| 7,048,473 | B2 * | 5/2006 | Takemiya | E01C 3/06 405/231 |
| 7,993,080 | B2 * | 8/2011 | Erez | E02D 17/20 405/284 |
| 8,459,903 | B2 * | 6/2013 | Senf | E02D 17/20 405/302.4 |
| 8,790,036 | B2 * | 7/2014 | Halahmi | E02D 17/202 404/28 |
| 8,920,068 | B1 * | 12/2014 | Free | E01C 19/4886 14/73 |
| 2005/0117978 | A1 * | 6/2005 | Loffel | E02D 17/20 405/302.4 |
| 2006/0147276 | A1 * | 7/2006 | Lin | E02D 17/20 405/302.4 |
| 2008/0253845 | A1 * | 10/2008 | Takeuchi | E02D 27/14 405/233 |
| 2009/0324346 | A1 * | 12/2009 | Milton | E02D 17/20 405/284 |
| 2010/0254795 | A1 * | 10/2010 | Halahmi | E02D 17/20 414/800 |
| 2013/0209179 | A1 * | 8/2013 | Erez | E02D 17/202 405/302.7 |

OTHER PUBLICATIONS

Babu et al., A Critical Review of Construction, Analysis and Behaviour of Stone Columns; Sep. 2012 (Year: 2012).*

Dash et al.; Improved performance of soft clay foundations using stone columns and geocell-sand mattress; Sep. 2013 (Year: 2013).*

* cited by examiner

GROUND REINFORCING DEVICE

TECHNICAL FIELD

The disclosure relates generally to the reinforcement of ground supporting a load structure, such as a tank, for instance a LNG tank, or other load structures such as nuclear plants, notably in seismic zones subject to soil liquefaction.

BACKGROUND OF THE ART

When a saturated, loose sandy or silty soil undergoes a dynamic stress, such as during an earthquake, it loses strength and stiffness while the pore water pressure in the ground increases, and can behave as a liquid. This phenomenon is called soil liquefaction.

Effects of soil liquefaction can cause lateral spreading of the foundation soil and/or significant damage to structures such as buildings, industrial structures, roads or bridges.

Some techniques are known to mitigate the damaging effects of soil liquefaction. They include:

- soil compaction which result in the densification of soil and enable load structure to withstand soil liquefaction;
- Installing vertical draining elements in the ground to prevent the pore water pressure to rise and therefore limit the risk of liquefaction;
  - Installing vertical inclusions (columns, panel) in the ground made of material with a higher shear strength (stone, grout, concrete, soil mixed with a binder for instance which can resist the shear stresses generated during an earthquake

SUMMARY

The present inventors have recognized that certain improvements can be made in the existing devices and methods. For example, one problem that the inventors have identified is that available solutions are either not fully accepted by the engineering and scientific community, or they do not offer sufficient shear strength, load bearing or settlement reduction for the supported structure. For example, draining may be efficient but some have doubts on its long-term efficiency and such a method may not support heavy structures. Soil densification may not be adapted to certain soil and loads. The mechanism involved for mitigation of liquefaction by increasing the shear strength are not yet fully accepted. Therefore there is no one cost-effective encompassing solution that has all the advantages to tackle liquefaction, whatever the soil type or mechanism considered, and that is able to support significant structural loading, prevent lateral spreading and control settlements.

In one aspect, there is provided a soil reinforcing device for reinforcing a ground supporting a load structure, wherein said soil reinforcing device comprises a first assembly including:

- a plurality of cells extending vertically and forming a cell mesh;
- a plurality of draining devices extending vertically and located in said cells.

The inventors have found that some draining devices can also generate a densification of the soil within the cells, which enhances the capacity of the cells to reduce the settlement. The association of cells and draining devices enable to significantly reduce soil liquefaction below the load structure during an earthquake, while also providing an increased bearing capacity to support the structure above.

In one aspect, the replacement ratio of each draining device is comprised between 5% and 12%, preferentially about 8%/10%.

In one aspect, each cell comprises one draining device.

In one aspect, each cell comprises vertical walls.

Preferentially, each cell comprises six vertical walls, and the cell mesh forms a honeycomb-type structure.

In one aspect, said vertical walls are connected to each other by linking columns.

In one aspect, said linking columns are jet-grouted columns or concrete columns.

In one aspect, the draining devices are separated from the vertical walls.

In one aspect, the vertical walls comprise a mixture of cut ground with a binder.

In one aspect, the draining devices extend in the middle of said cells.

In one aspect, said draining devices extend deeper than said cells.

In one aspect, the draining devices comprise stone columns.

In one aspect, the soil reinforcing device comprises a second assembly that includes exterior columns, wherein said second assembly, considered in a horizontal plane, surrounds the first assembly.

In one aspect, said exterior columns comprise exterior stone columns.

In yet another aspect, there is provided a system comprising the soil reinforcing device according to the invention.

In one aspect, the load structure has a load structure diameter; the first assembly has a first assembly diameter; and the first assembly diameter is greater than the load structure diameter.

In one aspect, the load structure is a LNG tank.

In yet another aspect, there is provided a method for making a soil reinforcing device according to the invention, comprising forming the cells using a in situ soil-mixing technique.

DESCRIPTION OF THE DRAWINGS

Reference is made to the accompanying figures in which.

DETAILED DESCRIPTION

Figure 1:
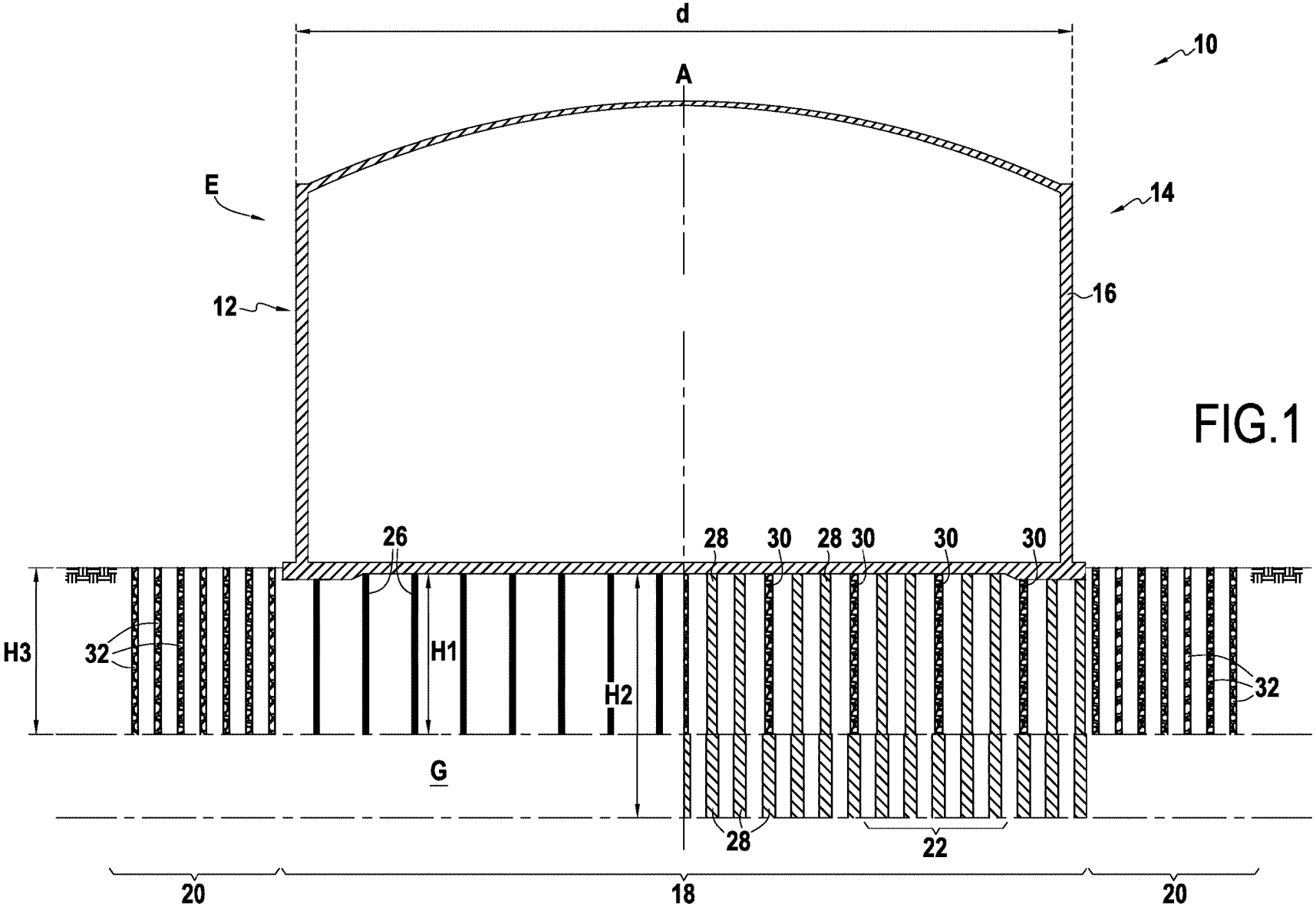
FIG. 1 is a cross-sectional view of a soil reinforcing device located in a ground and supporting a LNG tank according to exemplary embodiments of the present disclosure.

Referring to FIG. 1, a non-limiting example of a soil reinforcement device 10 for reinforcing a ground G supporting a load structure 12. In this example, the load structure may be a LNG (Liquefied Natural Gas) tank 14 comprising a cylindrical tank shell 16 which may have a diameter d of, for example, about 100 meters. The vertical axis A of the LNG tank shell is referenced as A in FIG. 1. The structure of such LNG tank is well known in the art and will not be further detailed. The height of the LNG tank shell may be about 50 meters.

Of course, the load structure could be another structure than a LNG tank, such as other tanks (water, oil, . . . ), heavy industrial structures (storage and bulk storage structures, processing plant, . . . ), infrastructures (bridges, embankments, . . . ).

Reinforced ground G may be, for example, made of silty sand.

Figure 2:
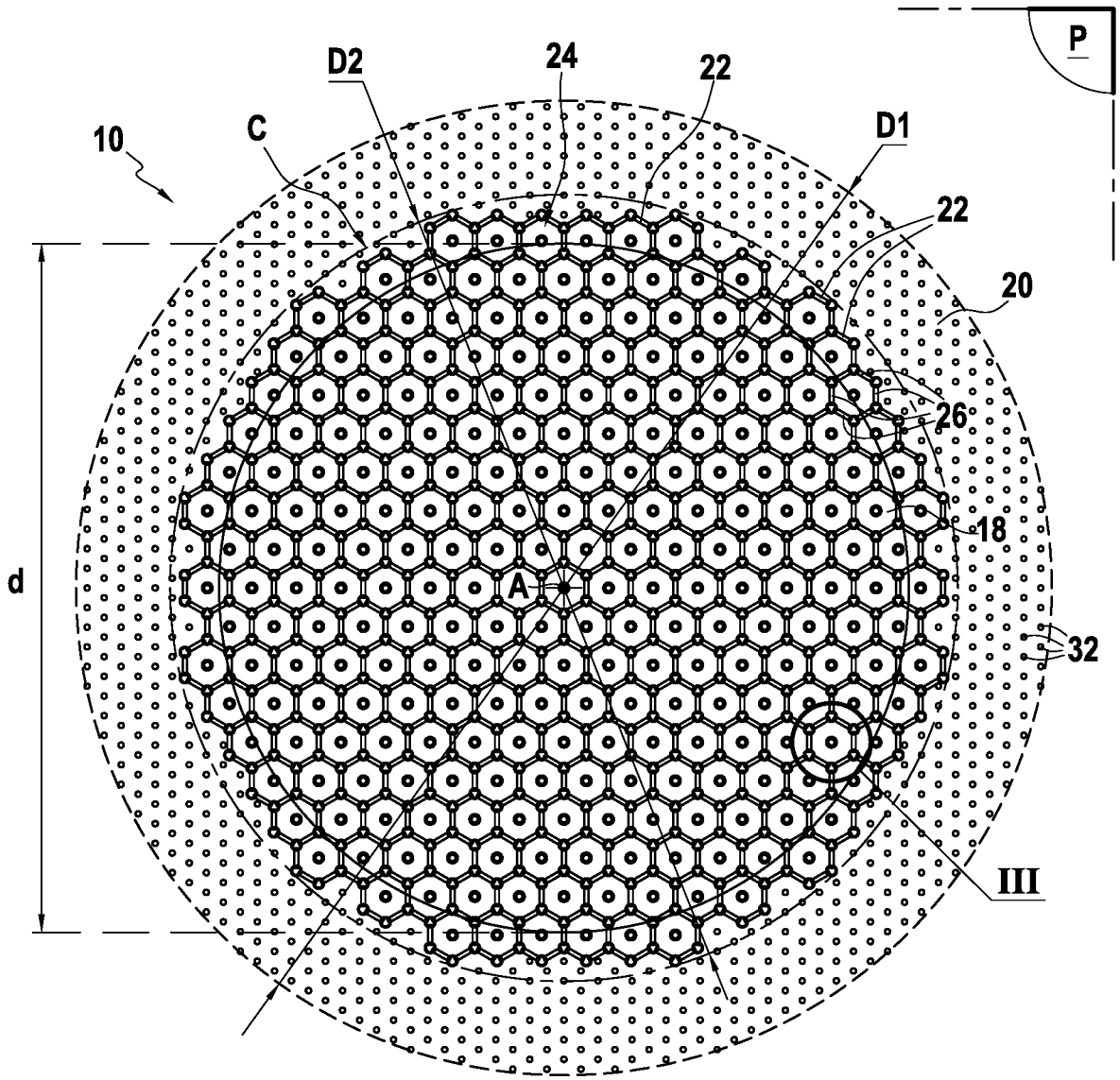
FIG. 2 is a top view of the soil reinforcing device of FIG. 1.

As better visible on FIG. 2, considered in a horizontal plane P, the reinforcing device 10 may have a general disc-shape which is centered on the axis A and may have an external diameter D1 of about 140 meters. As can be seen, the external diameter of the reinforcing device is about 40% more than the diameter of the LNG tank.

Without departing from the scope of the disclosure, the external diameter of the reinforcing device could be between 0% and 60% of the diameter of the load structure, for example.

The reinforcing device 10 comprises a first assembly 18 surrounded by a second assembly 20. As can be seen, the diameter of the second assembly may correspond to the external diameter D1 of the reinforcing device.

As can be seen in FIG. 2, the first assembly 18, which will be described below, may sit within a circle C whose diameter D2, namely the first assembly diameter, may be slightly greater than the diameter d of the LNG tank shell. In this example, the diameter D2 is about 110 m.

The first assembly 18 may comprise a plurality of cells 22 extending vertically and forming a cell mesh 24. In this non-limiting example, each cell 22 may comprise six vertical walls 26 so that the cell mesh 24 forms a honeycomb-type structure. In this exemplary embodiment, the first assembly comprises 253 cells.

Figure 3:
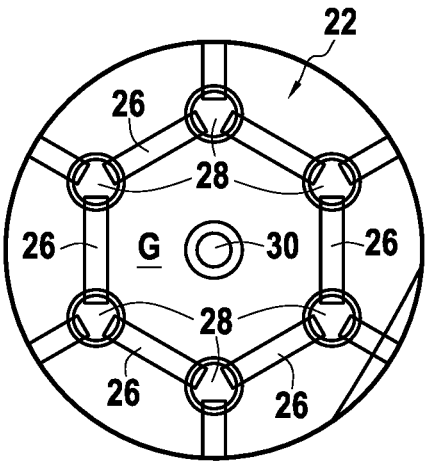
FIG. 3 is a detailed view of a cell of the first assembly with a draining device.

Turning now to FIG. 3, one of the cells 22 will be described in more detail. The vertical walls 26 may be connected to each other by, for example, six linking columns 28 which extend vertically as illustrated in FIG. 3.

In this example, the vertical walls 26 comprise a mixture of cut ground with a binder. The vertical walls 26 in one desirable embodiment can be made using a soil-mixing technique in which the ground is cut and mixed in situ with a binder.

In this non-limiting example, the vertical walls 26 have a height H1 of about 20 meters, a thickness of about 600 mm and a length of about 2800 mm.

The linking columns 28 may be jet-grouted columns. In other words, the linking columns 28 may be made using a jet-grouting technique. Such a technique is known in the art and will not be detailed here.

The diameter of the jet-grouting columns may have a diameter of about 1400 mm and a height H2 of about 30 meters. In other words, the linking columns 28 may extend deeper that the vertical walls 26. The distance between two adjacent linking columns may be, for example, about 3600 mm.

As can be seen in FIG. 2 and FIG. 3, the first assembly 18 may comprise a plurality of draining devices 30 extending vertically and located in said cells 22. More precisely, in this example each cell 22 comprises one single draining device 30 which is separated from vertical walls 26 and linking columns 28, and which extends in the middle of said cell. It is understood that the volume comprised between the draining device and the cell is ground.

As can be seen in FIG. 1, the draining devices may be extended deeper than the cells 22, with a draining element of the same or a different nature, or with a soil reinforcing element. In this exemplary embodiment, the draining devices are stone columns having a depth of about 20 meters and a diameter of about 900 mm, which are extended 10 m deeper by a jet grouting column.

Moreover, in this example the replacement ratio of the draining device is about 6 to 7%.

Turning now to FIG. 1 and FIG. 2, the second assembly 20 may extend annularly around the first assembly 18. Moreover, the radial distance between the shell tank 14 and the second assembly external diameter D1 may be, for example, about 20 meters. As can be seen in FIG. 1, while the first assemble 18 may extend generally below the LNG tank 14, the second assembly extends around it.

The second assembly 20 includes exterior columns 32 which may be regularly spaced one from each other. In other words, the exterior columns may be distributed homogeneously around the first assembly 18.

In this non-limiting example, the exterior columns 32 comprise exterior stone columns. Said stone columns have a height H3 of about 20 meters, and a diameter of about 750 mm.

A system E comprising the soil reinforcing device 10 and the LNG tank 14, where the first assembly diameter is greater that the LNG tank diameter may also be implemented.

Figure 4:
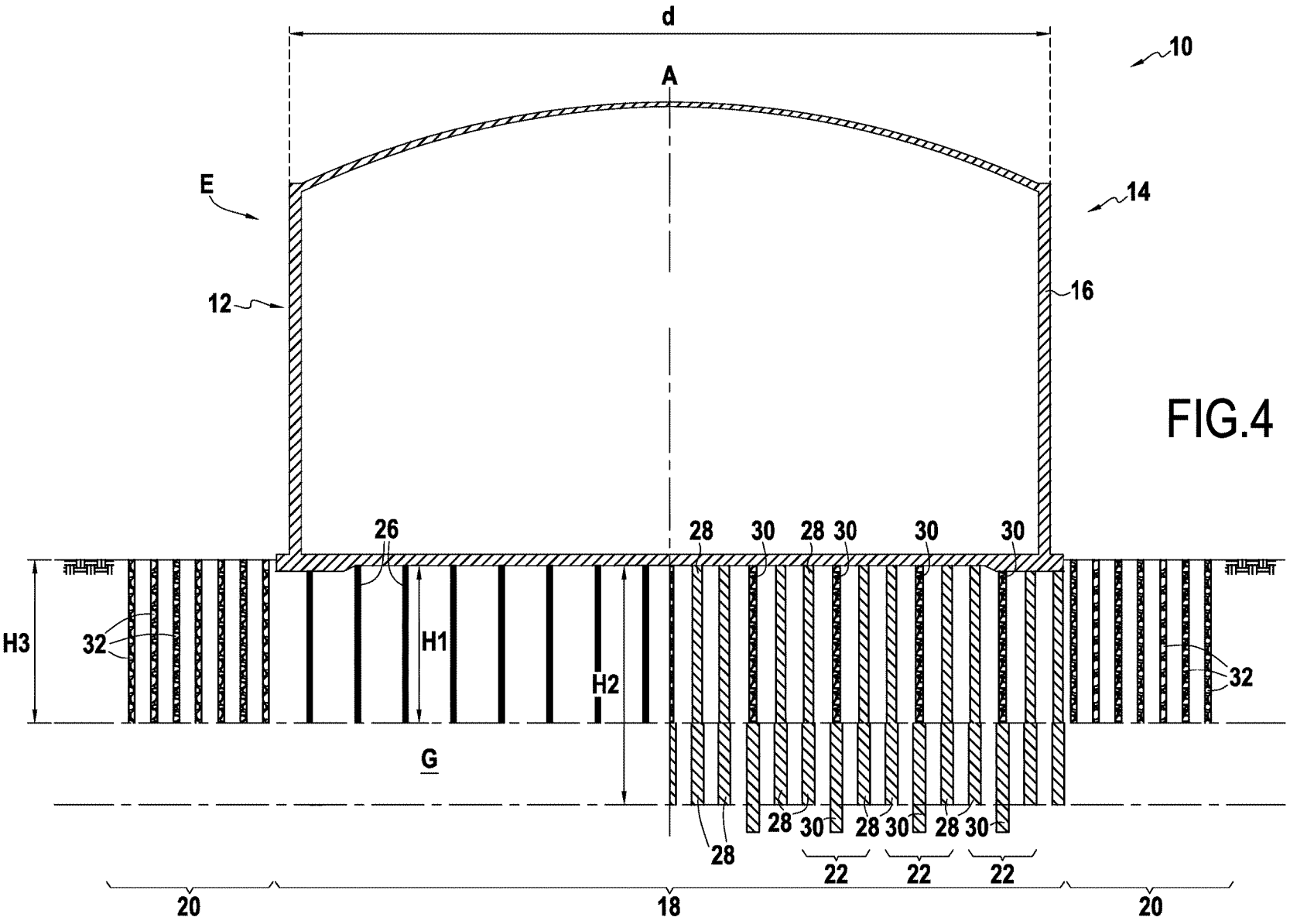
FIG. 4 is a cross-sectional view of a soil reinforcing device located in a ground, wherein the draining devices extend deeper than the cells, according to exemplary embodiments of the present disclosure.

FIG. 4 illustrates another non-limiting example of a soil reinforcement device 10 for reinforcing a ground G supporting a load structure 12. In this example, the draining devices are also stone columns extended deeper by a jet grouting column. The draining devices extend deeper than the linking columns and then than the cells 22.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

Additionally, even though some features, concepts or aspects of the inventions may be described herein as being a preferred arrangement or method, such description is not intended to suggest that such feature is required or necessary unless expressly so stated. Moreover, while various aspects, features and concepts may be expressly identified herein as being inventive or aiming part of an invention, such identification is not intended to be exclusive, but rather there may be inventive aspects, concepts and features that are fully described herein without being expressly identified as such or as part of a specific invention, the invention instead being set forth in the appended claims.

It is intended that the specification and examples be considered as exemplary only, with a true scope of the disclosure being indicated by the following claims.

The invention claimed is:

1. A soil reinforcing device for vertically reinforcing a ground supporting a load structure, wherein said soil reinforcing device comprises a first assembly including:

a plurality of cells extending in the ground vertically and forming a cell mesh, each cell comprising vertical walls;

a plurality of draining devices comprising columns, extending vertically and located within a volume of the cells, separated from the vertical walls.

2. The soil reinforcing device according to claim 1, wherein each cell comprises one draining device.

3. The soil reinforcing device according to claim 1, wherein each cell comprises six vertical walls, and the cell mesh forms a honeycomb-type structure.

4. The soil reinforcing device according to claim 1, wherein said vertical walls are connected to each other by linking columns.

5. The soil reinforcing device according to claim 4, wherein said linking columns are jet-grouted columns or concrete columns.

6. The soil reinforcing device according to claim 1, wherein the vertical walls comprise a mixture of cut ground with a binder.

7. The soil reinforcing device according to claim 1, wherein the draining devices extend in the middle of said cells.

8. The soil reinforcing device according to claim 1, wherein said draining devices extend deeper than said cells.

9. The soil reinforcing device according to claim 1, further comprising a second assembly that includes exterior columns, wherein said second assembly, considered in a horizontal plane, surrounds the first assembly.

10. The soil reinforcing device according to claim 9, wherein said exterior columns comprise exterior stone columns.

11. A system comprising:

a soil reinforcing device for vertically reinforcing a ground supporting a load structure, wherein said soil reinforcing device comprises a first assembly including:

a plurality of cells extending in the ground vertically and forming a cell mesh, each cell comprising vertical walls;

a plurality of draining devices comprising columns, extending vertically and located within a volume of the cells, separated from the vertical walls; and a load structure vertically supported by said first assembly.

12. The system according to claim 11, wherein:

the load structure has a load structure diameter;

the first assembly has a first assembly diameter; and wherein the first assembly diameter is greater than the load structure diameter.

13. The system according to claim 12, wherein the load structure is a LNG tank.

14. A method for making a soil reinforcing device for vertically reinforcing a ground supporting a load structure, wherein said soil reinforcing device comprises a first assembly including:

a plurality of cells extending vertically and forming a cell mesh, each cell comprising vertical walls;

a plurality of draining devices comprising columns, extending vertically and located within a volume of said cells, separated from the vertical walls thereof;

wherein said method comprises forming the vertical walls of the cells using an in situ soil-mixing technique.

* * * * *